US008900853B2

(12) United States Patent
Verhaar et al.

(10) Patent No.: US 8,900,853 B2
(45) Date of Patent: Dec. 2, 2014

(54) THERMOCYCLING DEVICE

(75) Inventors: Boudewijn Theodorus Verhaar, Eindhoven (NL); Jacobus Frederik Molenaar, Utrecht (NL); Martijn Cornelis Franciscus Vervoorn, Utrecht (NL)

(73) Assignee: Koninklijke Philips N.V., Eindhoven (NL)

( * ) Notice: Subject to any disclaimer, the term of this patent is extended or adjusted under 35 U.S.C. 154(b) by 306 days.

(21) Appl. No.: 13/063,961

(22) PCT Filed: Sep. 23, 2008

(86) PCT No.: PCT/IB2008/053854

§ 371 (c)(1), (2), (4) Date: Mar. 15, 2011

(87) PCT Pub. No.: WO2010/035063

PCT Pub. Date: Apr. 1, 2010

(65) Prior Publication Data

US 2011/0165628 A1 Jul. 7, 2011

(51) Int. Cl.
*B01L 7/00* (2006.01)
*B01L 3/00* (2006.01)

(52) U.S. Cl.
CPC ..... *B01L 7/52* (2013.01); *B01L 3/50851* (2013.01); *B01L 2300/1838* (2013.01); *B01L 2300/18* (2013.01)
USPC ..... 435/287.2; 435/91.2; 435/303.1; 435/305.1; 435/305.2; 219/386

(58) Field of Classification Search
USPC ..... 435/287.2, 91.2, 303.1, 305.1, 305.2; 219/386
See application file for complete search history.

(56) References Cited

U.S. PATENT DOCUMENTS

| | | | | |
|---|---|---|---|---|
| 5,038,852 | A | 8/1991 | Johnson et al. | |
| 2002/0030044 | A1* | 3/2002 | Brown | 219/386 |
| 2004/0149725 | A1 | 8/2004 | Brown | |
| 2005/0184042 | A1 | 8/2005 | Brown et al. | |

FOREIGN PATENT DOCUMENTS

| | | |
|---|---|---|
| EP | 1637228 | 3/2006 |
| EP | 1710017 | 10/2006 |
| WO | WO9843740 | 10/1998 |
| WO | WO2004024330 | 3/2004 |
| WO | WO2004105947 | 12/2004 |
| WO | WO2005050717 | 6/2005 |
| WO | WO2005084957 | 9/2005 |
| WO | WO2006105919 | 10/2006 |

* cited by examiner

*Primary Examiner* — Michael Marcheschi
*Assistant Examiner* — Timothy Barlow

(57) ABSTRACT

A thermocycling device includes a sample holder, a thermal reference and a heating and cooling device which is arranged between the sample holder and thermal reference. The heating and cooling device is in thermally conductive contact with the sample holder and with the thermal reference. The thermocycling device further includes a reference heating and cooling device for maintaining the temperature of the thermal reference at a predetermined temperature level during cycling, and a heat sink which is in thermally conductive contact with the reference heating and/or cooling device.

17 Claims, 3 Drawing Sheets

THERMOCYCLING DEVICE

FIELD OF THE INVENTION

The present invention is related to a thermocycling device, in particular to a thermocycling device for subjecting an object to a thermocycling protocol. In particular, the present invention is related to a thermocycling device for subjecting a sample comprising nucleic acids to a thermocycling protocol, like a polymerase chain reaction protocol.

BACKGROUND OF THE INVENTION

Thermocycling devices are apparatus for subjecting an object to a thermocycling protocol, i.e. to cycles in which the object is subjected to different temperatures in a repetitive fashion. Most commonly, these devices, also known as thermocyclers, are used in life science laboratories, where they are used for the amplification of nucleic acids according to a polymerase chain reaction (PCR) procedure. A thermocycler comprises a thermal block having facilities where samples can be placed. Furthermore, such device comprise a heating and cooling unit for raising and lowering the temperature of the block in discrete, pre-programmed steps. Basic principles of such thermocycling devices are for example disclosed in U.S. Pat. No. 5,038,852.

The device generates net heat which has to be dissipated. Otherwise, the overall performance of the device will suffer, i.e. the cooling and/or heating performance will decrease.

Excess heat generated in this process has thus to be discarded, or dissipated, into a heat sink from where it is, directly or indirectly, removed to the environment. This means, in turn, that the heat sink will become substantially warmer than the environment.

In the above identified environments, heat dissipation is a real challenge, especially when it comes to miniaturization of the devices, as it is required in high throughput laboratory environments, lab on a chip environments, highly integrated devices and the like.

For this reason, thermocyclers, especially peltier-equipped thermocyclers, comprise a large heat sink into which the generated heat is dissipated. These heat sinks are often connected to a cooling water circulation system being adjusted to a temperature of, e.g., 30° C. However, this results in additional apparatus requirements which are not compatible with the above identified miniaturization needs, and which mean high manufacturing costs and large maintenance efforts during operation.

Furthermore, it is desirable in many applications to speed up the thermocycling process. However, in a PCR protocol, for example, one can not simply shorten the duration of the different steps which take place at a given temperature (e.g. annealing, elongation and denaturation), as these are related to the efficiency of the process. The only option to speed up the process is to reduce the time the device needs to switch over from one step to the next, i.e. to heat up, or cool down, respectively, the sample holder with the samples comprised therein to the next temperature level. Thermocyclers comprising peltier elements suffer from this problem as well. Due to the limited heating and cooling performance of these devices, the time required for heating up or cooling down the sample holder is quite long in these thermocyclers, i.e. the so called "thermal ramps" are not very steep.

Considerable effort has been devoted to solve this problem. One approach is to reduce the thermal capacity of the sample holder, and to enhance the thermal conductivity of the sample holder as well as to enhance the thermal conductivity between the sample holder and the cooling and/or heating device. Another approach is to provide the sample holder with a thermally isolated lid. However, all these approaches do not fully satisfy the requirements related to speed of the thermocycling process.

WO 2006/105919 discloses a device for the simultaneous thermocycling of multiple samples comprising a thermal block, at least one heat pump, a heat sink, a control unit, and a thermal base which is in thermal contact with said heat sink and with said heat pump. The thermal base is a vapor chamber device especially a heat pipe for transporting and distributing heat. Using the thermal base in combination with the heat sink improves the heat dissipation and helps to decrease the required time for the cooling steps within the thermocycling protocol.

However, said thermal base does only enhance the heat dissipation by the heat sink. A disadvantage is that this effect is unidirectional, only affecting heat dissipation to the heat sink. Another disadvantage is that the thermal base can only be controlled in a way that the thermal base is switched "on" or "off". Therefore, this thermal base is only a passively working dissipation device.

OBJECT OF THE INVENTION

It is an object of the present invention to provide a thermocycling device for subjecting samples to a thermal cycling process in particular to a polymerase chain reaction.

This object is met with a device according to the independent claims. The dependent claims provide preferred embodiments.

SUMMARY OF THE INVENTION

Before the invention is described in detail, it is to be understood that this invention is not limited to the particular component parts of the devices described or process steps of the methods described as such devices and methods may vary. It is also to be understood that, in case parameter ranges are given which are delimited by numeric values, the ranges are deemed to include these limitation values.

According to the invention a thermocycling device comprising at least one sample holder, at least one thermal reference, and at least one heating and/or cooling device is provided. The latter is arranged between said sample holder(s) and said thermal reference, and in thermally conductive contact with said sample holder(s) and with the thermal reference. Furthermore, the device comprises at least one reference heating and/or cooling device for maintaining the temperature of the thermal reference at a predetermined temperature level during cycling and a heat sink which is in thermally conductive contact with said temperature control means.

DETAILED DESCRIPTION OF PREFERRED EMBODIMENTS

Figure 1:
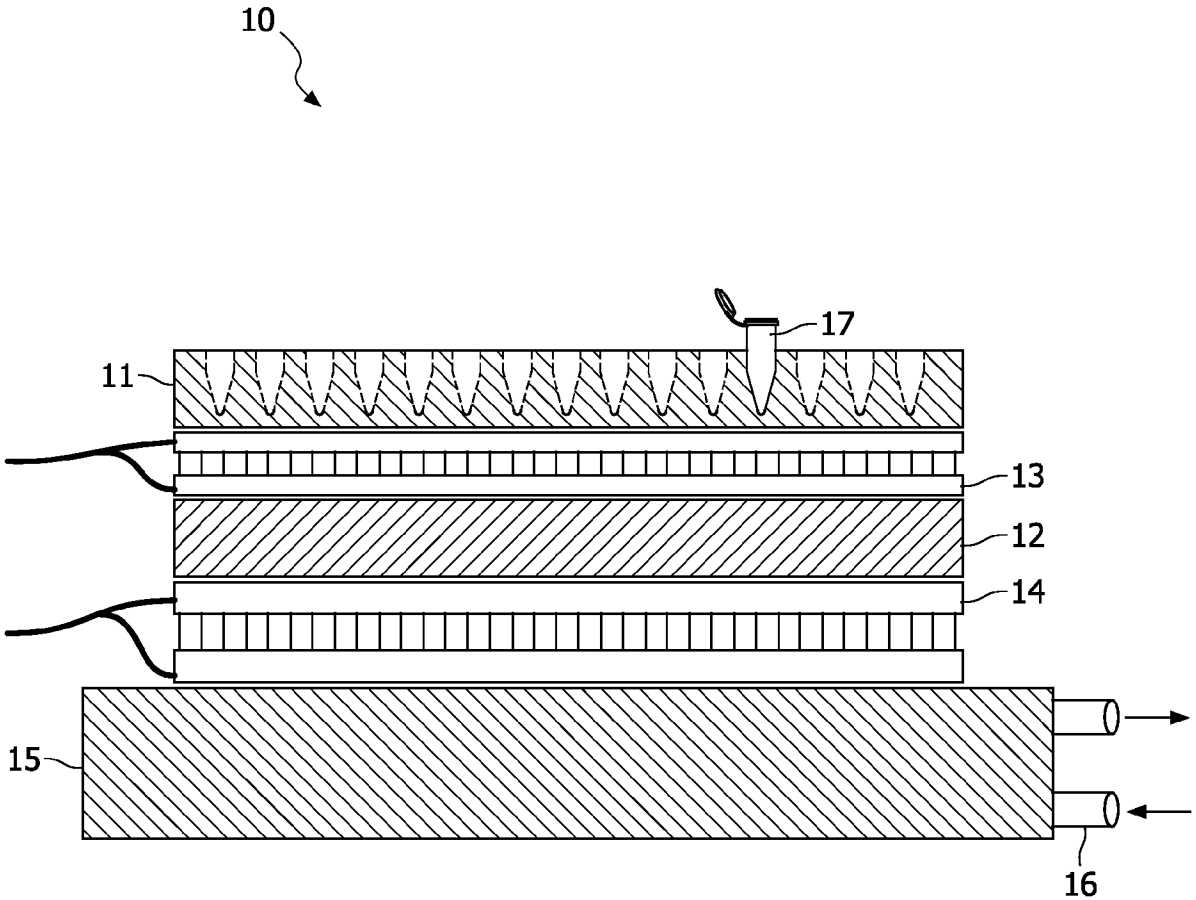
FIG. 1 shows a thermocycling device

As used herein, the term "Sample holder" refers to a device which is capable of receiving a sample, e.g. a biological sample comprising nucleic acids. These samples may be contained in dedicated receptacles, like microreaction tubes or microtiter plates.

As used herein, the term "Thermocycling protocol" refers to a protocol in which the at least one sample holder, and the sample(s) comprised therein, respectively, is repeatedly heated and/or cooled to at least two different temperature levels.

For this purpose, the heating and/or cooling device is, in a preferred embodiment, equipped with a microprocessor control unit and a memory, in which thermocycling protocols are stored.

In a preferred embodiment, the heating and/or cooling device is a thermoelectric device. This may for example be a thermionic emission device. In another preferred embodiment, the thermoelectric device is a thermotunnel cooling device. In another preferred embodiment, the thermoelectric device is a heat pump.

However, in a particularly preferred embodiment, the heating and/or cooling device is a peltier element. Likewise, the at least one reference heating and/or cooling device for the thermal reference may preferably comprise at least one thermoelectric device, more preferred at least one peltier element.

According to an embodiment of the present invention, the device can comprise at least one heating and/or cooling device, being arranged between the sample holder(s) and the thermal reference. According to a preferred embodiment of the present invention, the device can comprise a number of heating and/or cooling devices, being arranged between the sample holder(s) and the thermal reference. In this embodiment the heating and/or cooling devices are preferably a number of individual peltier elements. This can provide the advantage that single chambers of the sample holder can be temperature controlled independently to further optimize the thermocycling process.

A peltier element often referred to as thermoelectric heat pump or thermo-electric cooler is a solid-state active heat pump which transfers heat from one side of the device to the other. In a preferred embodiment, such device comprises of two ceramic plates made of $Al_2O_3$, between which small cubes made form p- and n-doted semiconducters, preferably elected from the group comprising $Bi_2Te_3$, $Sb_2Te_3$, $Bi_2Se_3$ and suchlike, are disposed, which are connected to one another with metal bridges at their tops, or bottoms, respectively, in an interchanging mode.

The device according to the invention can provide a reference heating and/or cooling device for controlling the temperature of the thermal reference. According to a preferred embodiment of the present invention, the device according to the invention does provide a reference heating and/or cooling device for maintaining the temperature of the thermal reference at a predetermined temperature level during cycling. A constant temperature reference for the heating and/or cooling device thus can be provided during cycling.

In case the heating and/or cooling device is a peltier element, one side of which is adjacent to a sample holder and the other side in contact with the thermal reference, the latter side will during cycling experience a constant temperature regardless of the actual state of the thermocycle, i.e. regardless of whether the sample holder is heated or cooled. The device according to the invention does thus provide conditions for a better performance of the heating and/or cooling device, particularly if the latter is a peltier element.

During the end-stages of the thermocycling protocol when the sample holders will be cooled to low temperatures for storage of samples, preferably around 0° C., more preferably between 0° C. to 10° C. or between 4° C. to 8° C., the reference temperature of the thermal reference can be reduced. The device according to the invention can provide a reference heating and/or cooling device for maintaining the temperature of the thermal reference at a predetermined temperature level during storage. A constant temperature reference for the heating and/or cooling device can be provided during storage. Preferably, the constant temperature reference during storage is lower than the constant temperature reference during cycling.

The device according to the invention can thus provide a reference heating and/or cooling device for maintaining the temperature of the thermal reference at a predetermined temperature level during cycling and for maintaining the temperature of the thermal reference at a preferably different predetermined temperature level during storage.

The above mentioned reference heating and/or cooling device thus can provide a device for actively maintaining the temperature of the thermal reference at a predetermined level, even if heat or chill is dissipated from said heating and/or cooling device into said thermal reference.

The temperature of the thermal reference can be varied. In general, it is preferred that the thermal reference is maintained at a predetermined temperature level during cycling. This means that regardless of the fact whether the sample holder is heated or cooled, the thermal reference has a constant temperature.

It is further preferred that the thermal reference is maintained at another predetermined temperature level during storage. The temperature level during storage is preferably a lower temperature level than the temperature level during cycling.

According to the present invention a thermal reference is provided that can be temperature controlled at any time. The device according to the invention can provide in improvement of process efficiency. Especially an increase in ramp speed and/or a decrease in energy use can contribute to the efficiency of the process.

According to a preferred embodiment of the present invention the thermal reference can serve as a "thermal buffer", in which heat can be stored which otherwise would be dissipated from the device via the heat sink. It can be preferred that the stored heat is used to handle temporal variations of the thermal load to prevent that the heating and/or cooling devices especially peltiers need to handle the temporal variations. In that case, the thermal reference, or thermal buffer, can serve as a "temporal buffer". It can be further preferred that the stored heat can be used to heat another sample holder. For example the thermal reference can level spatial distribution of the thermal load by distributing heat to asynchronously cycling heating and/or cooling devices, especially peltier elements. In that case, the thermal reference, or thermal buffer, can serve as a "spatial buffer".

The device according to the invention can provide a faster and/or more efficient temperature control of the sample holder and the samples. Especially advantageously, the overall heat dissipation of the device can be reduced.

In a preferred embodiment, the device comprises a heat sink which is in thermally conductive contact with said reference heating and/or cooling device. Said reference heating and/or cooling device mostly will remove heat to be dissipated. For this purpose, a heat sink is required. However, the reference heating and/or cooling device may also take heat from the heat sink, for example when all samples and/or sample holders are heated simultaneously.

The heat sink may for example be a conventional heat sink, i.e. a finned cooler. The latter may optionally be equipped with a fan. In another embodiment, said heat sink may comprise a cooling water circulation system.

In another preferred embodiment, the thermal reference, the at least one sample holder and/or the heat sink comprise at least one highly thermal conductive material, preferably selected from the group comprising copper, silver and/or aluminum, and/or ceramics, cermets and/or alloys comprising the former, especially preferably selected from the group comprising copper and/or aluminum, and/or ceramics, cermets and/or alloys comprising the former. This feature is beneficial in order to speed up the heating and/or cooling of the sample holder and the samples comprised therein The thermal capacity of the thermal reference depends on the application. Furthermore, it is preferred that the device comprises means for adjusting and/or maintaining the temperature level of the thermal reference to a value between at least two different temperature levels of the thermocycling protocol. This means that, provided that a thermocycling protocol is executed in which a sample holder is repeatedly subjected to three different temperature levels (e.g. 66, 70 and 94° C.), the temperature level of the thermal reference is for example controlled to a value which is between the two extreme values of said protocol. Thus, the thermal gap, or temperature difference (ΔT), between the sample holder and the thermal reference, which is to be bridged by the heating and/or cooling device (i.e. the temperature difference over which the heating and/or cooling device has to pump the heat) is reduced to a minimum. This leads to a reduction of the energy consumption of the heating and/or cooling device, which is particularly beneficial in laboratory applications, as it allows the downscaling of the respective power supply, which leads to a reduction of the heat dissipation of the latter.

In other embodiments, the first temperature may for example adopt 56° C. instead of 66° C.

Furthermore, this leads to a reduction of the heat generated by the heating and/or cooling device, and to a decrease of the heat dissipation requirements. This in turn allows a reduction of the heat sink.

The device can provide less energy use which can provide less heat transport and/or the possibility of a downscaling of the power supply. It can be especially beneficial that less space for the device is necessary, especially in a laboratory. Moreover, downscaling of the power supply can result in a reduced heat transport. Lower temperatures can provide the advantage that no fan may be needed.

Process time can be decreased, especially the temperature ramp speed can be increased. Generally, the device can provide increased efficiency.

In a preferred embodiment, the temperature level of the thermal reference is adjusted and/or maintained to a value which is close to the arithmetic mean of two different temperature levels adopted successively in the thermocycling protocol. In the above mentioned example, the said temperature level of the thermal reference could be controlled to be about 80° C. In other examples, it can be preferred also that the temperature level of the thermal reference could be controlled to be about 70° C.

In another preferred embodiment, the temperature level of the thermal reference is adjusted and/or maintained to a value which is below the arithmetic mean of two different temperature levels adopted successively in the thermocycling protocol, but above the lower level of said two different temperature levels. This preferred embodiment is especially beneficial as it will further reduce the heat dissipation and the energy consumption of the device. This is due to the fact that maintaining a positive temperature gap between the sample holder and the reference (sample holder minus reference temperature) requires less heat than maintaining a negative temperature gap.

Provided the said temperature level of the thermal reference would be controlled to be about 70° C., the heating and/or cooling device would, for cooling the sample holder down to a temperature of 66° C., have to bridge a thermal gap (ΔT) of −4° C. In contrast thereto, for heating the sample holder up to a temperature of 94° C., the heating and/or cooling device would have to bridge a thermal gap (ΔT) of +24° C.

In case 56° C. is chosen as the first temperature level, the heating and/or cooling device has, for cooling the sample holder down, to bridge a thermal gap (ΔT) of −14° C.

Without said thermal reference, the thermal gap would depend on the ambient temperature and the heating or cooling process itself. This would in some cases result in a process being unbridgeable or, at least, energy inefficient. One major advantage is therefore that the thermal gaps can be chosen and thus optimized for different criteria like energy, speed and/or size.

Another advantage is that the speed of the heating and of the cooling step can be sped up by use of a thermal reference having preferably a temperature between at least two different temperature levels of the thermocycling protocol, more preferably near the centre of the range of the temperature cycle since the thermal gap (ΔT) is reduced. Maintaining a larger temperature gap causes a larger heat 'leakage' from the hot side to the cold side; hence a larger current is required to compensate for this heat leakage. Yet a higher current requires larger electrical power input, e.g. due to internal electrical resistance of the Peltier devices, and thus a large power supply which is highly demanding in terms of space and costs, and which dissipates more heat, which all make such device unfavorable for the applications set forth above.

In another preferred embodiment, the temperature level of the thermal reference is adjusted and/or maintained to a lower value, e.g. near ambient temperature in case the thermocycling protocol provides a temperature value between 0° C. and 10° C., especially when it comes to the post-amplification storage of the amplified products.

The term "ambient temperature", as used herein, refers to the temperature in the immediate surrounding of the device. In some cases, where a water cooling device is used with a temperature of about 40° C., the "ambient temperature" in the above meaning may thus adopt a value of 40° C. In other cases, where air cooling with room temperature is used the "ambient temperature" in the above meaning may thus adopt a value of, say, 25° C.

It can be preferred that the temperature level of the thermal reference is controlled to be about 40° C. during storage. In other examples it can be preferred also that the temperature level of the thermal reference is controlled to be about 25° C. during storage.

Preferably, the thermocycling device according to the invention is a thermocycler for nucleic acid amplification. Likewise, the invention is related to the use of a thermocycling device according to the invention for nucleic acid amplification.

The term "nucleic acid" as used herein refers to both DNA and RNA. Preferably, it refers to plasmidic, genomic, viral, mitochondrial and cDNA as well as mRNA, dsRNA, siRNA, miRNA, rRNA, snRNA, t-RNA, and hnRNA.

Within the scope of the present invention all nucleic acid amplifications known to someone skilled in the art are applicable, e.g. Polymerase Chain Reaction (PCR), Ligase Chain Reaction (LCR), Polymerase Ligase Chain Reaction, Gap-LCR, Repair Chain Reaction (RCR), strand displacement amplification (SDA), transcription mediated amplification (TMA), Cycling Probe Technology reaction (CPT) or Qβ replicase assay.

The most preferred method for nucleic acid amplification is the Polymerase Chain Reaction (PCR). The basic concepts of this method are disclosed in U.S. Pat. No. 4,683,202 the contents of which are herein incorporated by reference.

In the PCR process, a thermocycling protocol is applied which for example comprises the following temperature levels:

A) Denaturation temperature: 94-96° C. At this temperature, the hydrogen bonds between the two strands of the double stranded nucleic acid molecules (including primers which have hybridized) are released, resulting in two single strands. Basically even higher temperatures would result in a faster denaturation (also called, and herein synonymously used, as "melting"), but the polymerase enzyme ("Taq Polymerase") will decompose at higher temperatures.

B) Annealing temperature: 50-70° C. At this temperature, the annealing (i.e. sequence specific hybridization) of the primers takes place. The optimum temperature depends on the AT/GC-content of the primers; AT-rich primers require low annealing temperatures, whereas GC-rich primers require high annealing temperatures C) Elongation temperature: 60-75° C. At this temperature, the elongation process takes place. The chosen temperature is dependent on the temperature optimum of the respective polymerase.

D) Storage temperature: 0-10° C. Once the amplification cycle is finished, the samples are cooled down to a temperature below 10° C. for storage, in order to prevent disintegration of the amplified nucleic acids A thermocycling protocol for PCR does for example comprise the following steps:

| Step (temperature level) | | duration | temperature | repeats |
|---|---|---|---|---|
| Primary Denaturation (A) | | 120 s | 94° C. | 1 |
| Amplification | Annealing (B) | 30 s | 66° C. | 35 x |
| | Elongation (C) | 30 s | 72° C. | |
| | Denaturation (A) | 30 s | 94° C. | |
| Final Annealing (B) | | 30 s | 66° C. | 1 |
| Final Elongation (C) | | 120 s | 4° C. | 1 |
| Storage (D) | | unlimited | 4° C. | 1 |

In the course of temperature levels A-C, which are repeated according to the amplification protocol, the temperature of the thermal reference is maintained at a temperature which is between the annealing temperature and the denaturation temperature.

Preferably, the temperature of the thermal reference is maintained at a temperature the amount of which is the arithmetic mean between the annealing temperature and the denaturation temperature.

Yet in another preferred embodiment, the temperature of the thermal reference is maintained at a temperature which is closer to the annealing temperature than to the denaturation temperature. This is due to the fact that it requires less heat dissipation if a thermoelectric is used for heating, than if it is used for cooling.

In Step D, the temperature of the thermal reference is maintained at a temperature which is between the elongation temperature and the storage temperature. Preferably, the temperature of the thermal reference is maintained to ambient temperature in this case.

Other potential uses for such a device may for example comprise material testing, i.e. subjecting a test specimen to a given temperature cycle in order to test for accelerated ageing behavior. Other possible uses of the device according to the invention include the use as an incubator device, a cell culturing device, a fermentation device, a bioreactor and the like.

Furthermore, the invention provides a process for subjecting at least one sample to a thermal cycling process with a device according to the above invention, wherein the temperature level of the thermal reference is adjusted and/or maintained to a predetermined temperature level during cycling. Said sample is preferably a biological sample comprising nucleic acids. The thermocycling protocol is preferably a PCR protocol. As regards details and advantages of this process, reference is made to the above specification.

In a preferred embodiment, the temperature level of the thermal reference is adjusted and/or maintained to a value which is between at least two different temperature levels of the thermocycling protocol.

Yet in another preferred embodiment, the temperature level of the thermal reference is adjusted and/or maintained to a value near ambient temperature in case the thermocycling protocol provides a temperature value between 0° C. and 10° C.

Additional details, features, characteristics and advantages of the object of the invention are disclosed in the subclaims, the figures and the following description of the respective figure and examples, which, in an exemplary fashion, show preferred embodiments of the cell lysis and/or mixing device, or the microfluidic device according to the invention. However, these drawings should by no means be understood as to limit the scope of the invention.

FIG. 1 shows a thermocycling device 10 comprising a sample holder 11, a thermal reference 12 and a heating and/or cooling device 13, being arranged between said sample holder 11 and said thermal reference 12. The heating and/or cooling device 13 consists of a peltier element, which is in thermally conductive contact with the sample holder 11 and with the thermal reference 12. The peltier element 13 is wired to a control unit provided with a power supply (not shown in FIG. 1), and it is selected so that it is capable of subjecting the sample holder to a thermocycling protocol comprising at least two different temperature levels.

Furthermore, the device comprises a reference heating and/or cooling device 14 for maintaining the temperature of the thermal reference 12 at a predetermined temperature level during cycling. The reference heating and/or cooling device 14, which consists of another peltier element, is in thermally conductive contact with a heat sink 15. The latter is connected to a water cooling cycle via two fittings 16. The peltier element 14 is wired to another control unit provided with a power supply (not shown in FIG. 1), and it is selected so that it is capable of maintaining the temperature of the thermal reference 12 at a predetermined temperature level during cycling.

The sample holder 11 is designed in such way that it may receive microreaction tubes 17, which comprise biological samples, for example.

Figure 2:
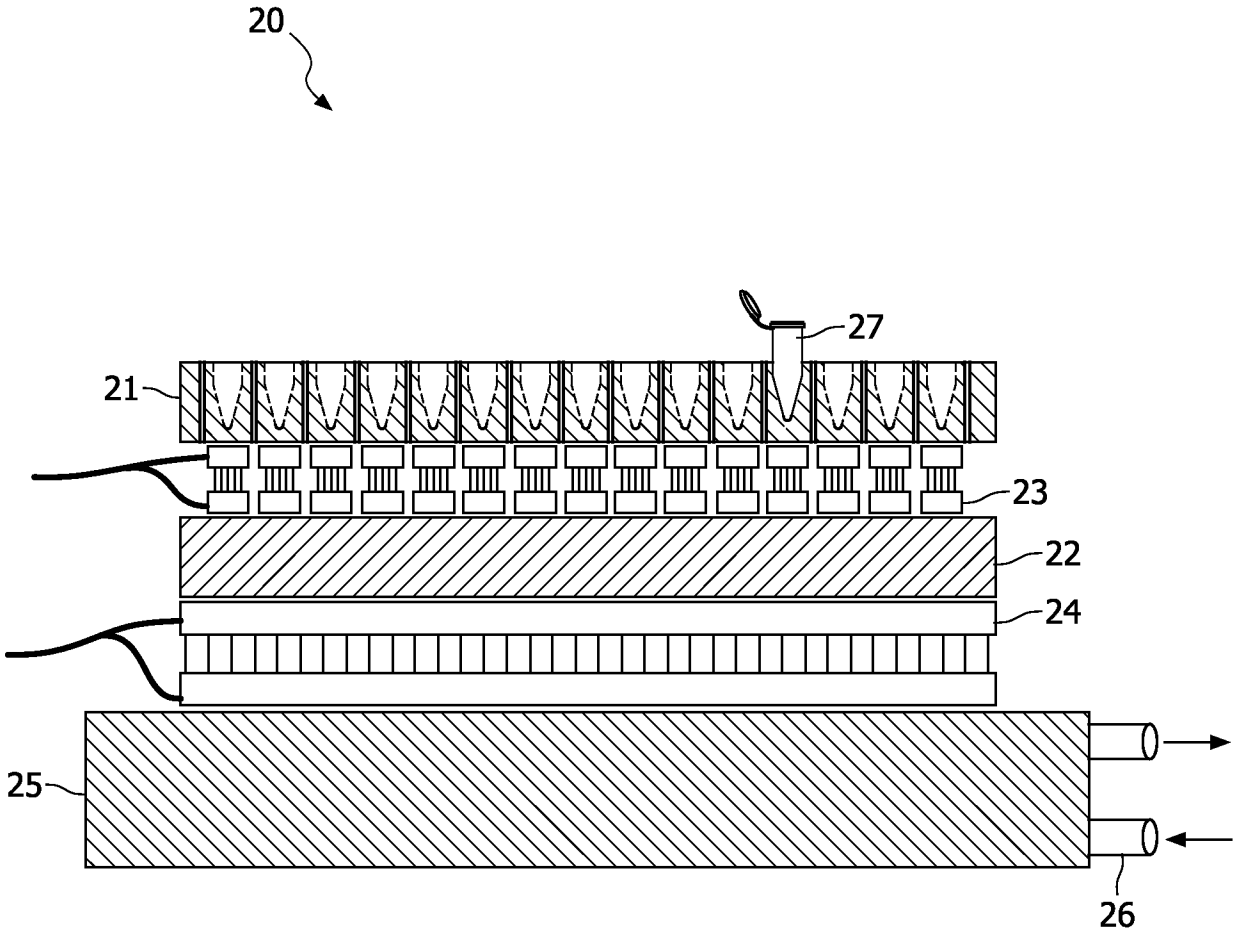
FIG. 2 shows a different embodiment thermocycling device

FIG. 2 shows a different embodiment thermocycling device 20 comprising a sample holder 21 with thermally insulated receptacles, a thermal reference 22 and a number of heating and/or cooling devices 23, being arranged between said sample holder 21 and said thermal reference 22. The heating and/or cooling devices 23 consists of individual peltier elements, which are in thermally conductive contact with the different thermally insulated receptacles of the sample holder 21, and with the thermal reference 22. The peltier element 23 is wired to a control unit provided with a power supply (not shown in FIG. 2), and it is selected so that it is capable of subjecting the different thermally insulated receptacles of the sample holder 21 to individual thermocycling protocols comprising at least two different temperature levels.

Furthermore, the device comprises a reference heating and/or cooling device 24 for maintaining the temperature of the thermal reference 22 at a predetermined temperature level during cycling. The reference heating and/or cooling device 24, which consists of another peltier element, is in thermally conductive contact with a heat sink 25. The latter is connected to a water cooling cycle via two fittings 26. The peltier element 24 is wired to another control unit provided with a power supply (not shown in FIG. 2), and it is selected so that it is capable of maintaining the temperature of the thermal reference 22 at a predetermined temperature level during cycling.

The sample holder 21 is designed in such way that it may receive microreaction tubes 27, which comprise biological samples, for example. By providing the option of individually heating and/or cooling the different thermally insulated receptacles of the sample holder 21, individual thermocycling protocols can be provided for different samples contained in the microreaction tubes. This is for example required for multiplexed PCR approaches, wherein different primers are used which have different AT:GC content or vary in their length, or wherein the length of the amplified nucleic acids varies. These multiplexed RCR approaches do thus require different annealing temperatures, different annealing times, and/or different elongation and/or denaturation times.

Figure 3A:
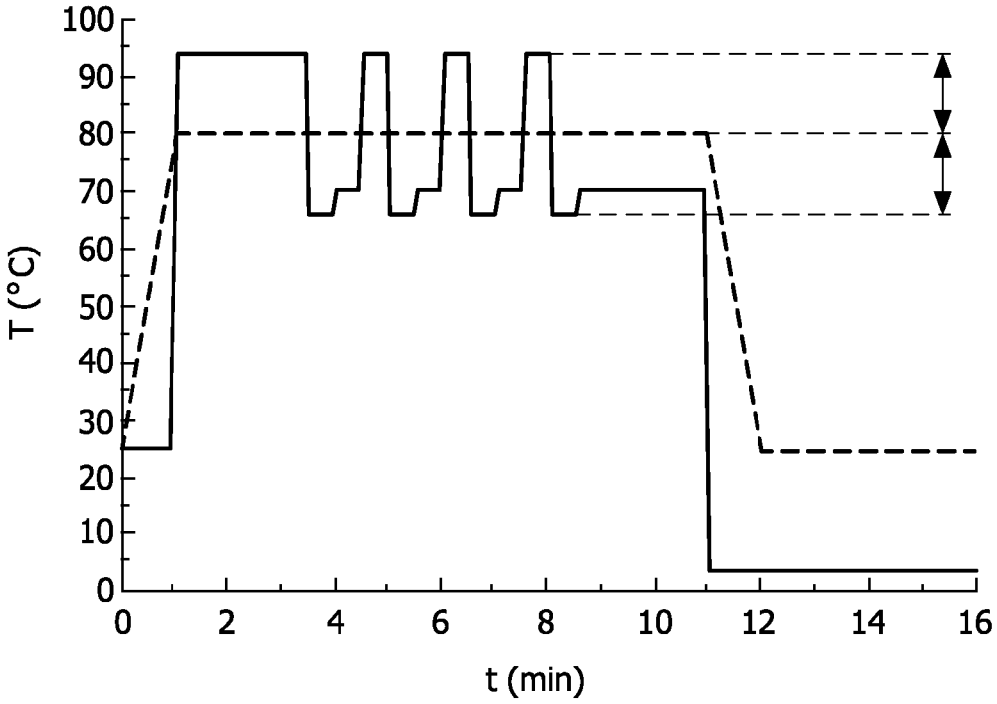
FIG. 3A shows, exemplarily, a PCR thermocycling protocol

FIG. 3A shows, exemplarily, a PCR thermocycling protocol. For reasons of clarity, only three amplification cycles are shown. Usually, the number of thermocycles ranges between 10 and 100. The thermocycle consists of a primary denaturation step at 94° C. Herein, the hydrogen bonds between the complementary nucleotides are released and the double-stranded nucleic acid molecule is converted into two single stranded molecules. Then, the amplification cycle, which consists of subsequent annealing, elongation and denaturation steps, begins.

Annealing takes place at a relatively low temperature (e.g. 66° C. or 56° C.) at which the annealing (i.e. sequence specific hybridization) of the primers to the single stranded nucleic acid molecules takes place. However, the optimum temperature depends on the AT/GC-content of the primers; AT-rich primers require low annealing temperatures, whereas GC-rich primers require high annealing temperatures.

Elongation takes place, in the present example, at a temperature of 70° C. In this step, a thermoresistant polymerase takes a single stranded nucleic acid molecule as a template, and, while using the 3'-terminus of the primer as starting point, couples nucleotides complementary to the respective nucleotides of the template are coupled to the primer. The chosen temperature is however dependent on the temperature optimum of the respective Polymerase. The most popular polymerase, Taq Polymerase, elongates optimally at a temperature of 72° C. This step takes approximately one minute per one thousand base pairs. Thereafter, a new denaturation step is applied.

Once the selected number of cycles is done, a final elongation step takes place, which lasts longer than the preceding elongation steps. This step is useful to ensure that any remaining single stranded nucleic acids are completely elongated.

Thereafter, the samples are cooled down to a temperature below 10° C. for storage, in order to prevent disintegration of the amplified nucleic acids During the amplification process, the temperature level of the thermal reference (grey horizontal bar) is adjusted to a value which is close to the arithmetic mean between the annealing temperature (66° C.) and the denaturation temperature (94° C.), i.e. 80° C. This means that for cooling the sample holder down to a temperature of 66° C. for annealing, the peltier device has to bridge a thermal gap (ΔT) of −14° C., whereas for heating the sample holder up to a temperature of 94° C., the heating and/or cooling device has to bridge a thermal gap (ΔT) of +14° C., as indicated by the arrows.

In case the annealing temperature were 56° C., one would adjust the temperature level of the thermal reference to a lower value, e.g. 75° C., which is again the arithmetic mean between the annealing temperature and the denaturation temperature.

Figure 3B:
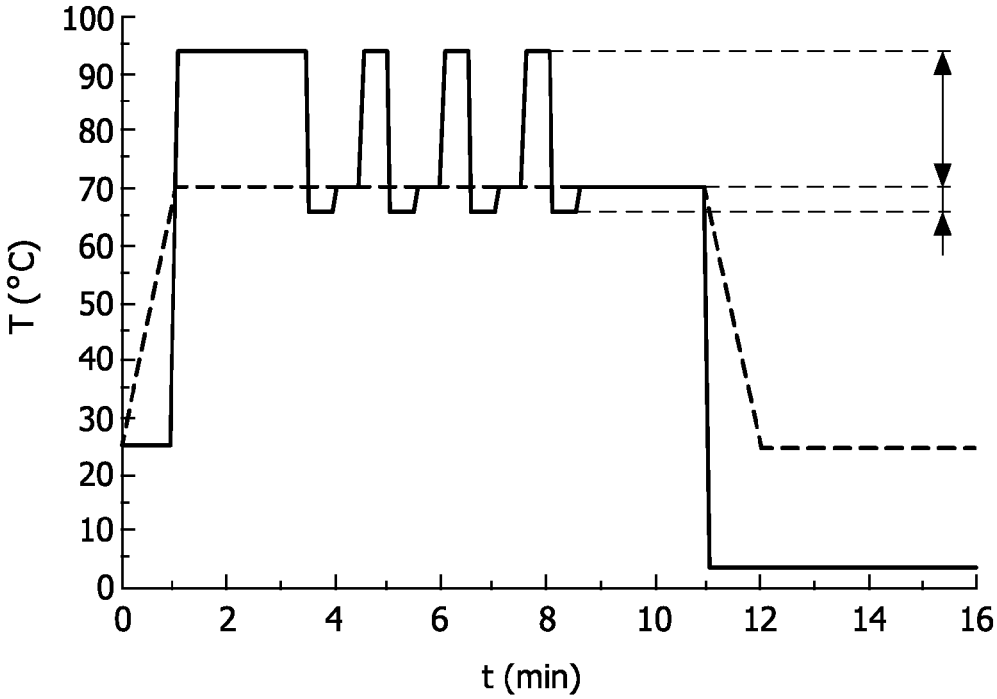
FIG. 3B shows the same PCR thermocycling protocol. However, in this case the temperature level of the thermal reference (grey horizontal bar) is adjusted to a value which is below the arithmetic mean between the annealing temperature and the denaturation temperature, but still higher than the annealing temperature

FIG. 3B shows the same PCR thermocycling protocol. However, in this case the temperature level of the thermal reference (grey horizontal bar) is adjusted to a value which is below the arithmetic mean between the annealing temperature and the denaturation temperature, but still higher than the annealing temperature. In this case, the temperature level of the thermal reference is adjusted to a value equal to the elongation temperature, i.e. 72° C.

This embodiment is beneficial in that it further reduces the heat dissipation and the energy consumption of the device. This is due to the fact that the heating performance of a peltier device is always better than the cooling performance. In the example of FIG. 3B, the peltier device has to bridge a thermal gap (ΔT) of −6° C. for cooling the sample holder down to a temperature of 66° C. for annealing. In contrast thereto, for heating the sample holder up to a temperature of 94° C., the heating and/or cooling device would have to bridge a thermal gap (ΔT) of +22° C. The thermal gaps are indicated by the arrows.

In case the annealing temperature were 56° C., one would again adjust the temperature level of the thermal reference to a lower value, e.g. 66° C. Again, due to the fact that peltier elements are more efficient in heating than in cooling, In both cases, the thermal gap for cooling is smaller (−6° C., or −10° C., respectively) than the thermal gap for heating (+22° C., or +28° C., respectively). The said arrangement of temperature levels does thus account for the fact that Peltier elements are less effective in cooling than they are in heating.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The particular combinations of elements and features in the above detailed embodiments are exemplary only; the interchanging and substitution of these teachings with other teachings in this and the patents/applications incorporated by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto. Furthermore, reference signs used in the description and claims do not limit the scope of the invention as claimed.

The invention claimed is:

1. A thermocycling device comprising:

a sample holder;

a thermal reference;

a heating and cooling device arranged between said sample holder and said thermal reference and being in thermally conductive contact with said sample holder and with the thermal reference, wherein the heating and cooling device is controlled for subjecting the sample holder to thermocycling;

a reference heating and cooling device;

a processor configured to control the reference heating and cooling device to maintain a temperature level of the thermal reference that is between an annealing temperature level and a denaturation temperature level of a thermocycling protocol performed during the thermocycling; and a heat sink which is in thermally conductive contact with said reference heating and cooling device, wherein the reference heating and cooling device is located between the thermal reference and the heat sink.

2. The thermocycling device according to claim 1, wherein the heating and cooling device and the reference heating and cooling device comprise at least one of a thermoelectric device and a peltier element.

3. The thermocycling device according to claim 1, wherein at least one of the thermal reference, the sample holder, and the heat sink comprises at least one of copper, aluminum, ceramics and cermets.

4. The thermocycling device according to claim 1, wherein the device is a thermocycler for nucleic acid amplification.

5. A process for subjecting at least one sample to a thermal cycling process with a device according to claim 1, wherein the temperature level of the thermal reference is adjusted and/or maintained to a predetermined temperature level during cycling.

6. The process according to claim 5, characterized in that the temperature level of the thermal reference is adjusted and/or maintained to a value which is between at least two different temperature levels of the thermocycling protocol.

7. The process according to claim 5, characterized in that the temperature level of the thermal reference is adjusted and/or maintained to a value near ambient temperature in case the thermocycling protocol provides a temperature value between 0° C. and 10° C.

8. The thermocycling device according to claim 1, wherein the thermocycling device is a thermocycler for carrying out a polymerase chain reaction.

9. The thermocycling device of claim 1, wherein the processor is further configured to control the reference heating and cooling device to maintain the temperature level of the thermal reference at an arithmetic mean of the annealing temperature level and the denaturation temperature level.

10. The thermocycling device of claim 1, wherein the processor is further configured to control the reference heating and cooling device to maintain the temperature level of the thermal reference below an arithmetic mean of the annealing temperature level and the denaturation temperature level and above the annealing temperature level.

11. The thermocycling device of claim 1, wherein the processor is further configured to control the reference heating and cooling device to maintain the temperature level of the thermal reference at a storage temperature level during storage, wherein the storage temperature is different from the temperature level of the thermal reference maintained during the thermocycling.

12. The thermocycling device of claim 1, wherein the thermocycling protocol includes a polymerase chain reaction.

13. A thermocycling device for carrying out a polymerase chain reaction, comprising:

a sample holder;

a thermal reference;

a heating and cooling device both intermediate and in thermal contact with the sample holder and the thermal reference;

a reference heating and cooling device in thermal contact with the thermal reference;

a heat sink in thermal contact with the reference heating and cooling device;

a processor configured to control the reference heating and cooling device during the polymerase chain reaction to maintain a temperature level of the thermal reference at a value which is between an annealing temperature and a denaturation temperature.

14. The thermocycling device according to claim 13, wherein the processor is further configured to control the reference heating and cooling device during the polymerase chain reaction to maintain the temperature level of the thermal reference at a value which is approximately an arithmetic mean between the annealing temperature and the denaturation temperature.

15. The thermocycling device according to claim 13, wherein the processor is further configured to control the reference heating and cooling device during the polymerase chain reaction to maintain an approximately equal difference between (1) the annealing temperature and the thermal reference temperature level, and (2) the denaturation temperature and the thermal reference temperature level.

16. The thermocycling device according to claim 13, wherein the processor is further configured to control the reference heating and cooling device during the polymerase chain reaction to maintain the temperature level of the thermal reference at a value which is below an arithmetic mean between the annealing temperature and the denaturation temperature.

17. The thermocycling device according to claim 13, wherein the processor is further configured to control the reference heating and cooling device during the polymerase chain reaction to maintain a difference between (1) the annealing temperature and the thermal reference temperature level that is smaller than the difference between (2) the denaturation temperature and the thermal reference temperature level.

* * * * *